United States Patent [19]

Hyman

[11] Patent Number: 4,566,473

[45] Date of Patent: Jan. 28, 1986

[54] AIR BAFFLED HAIRBRUSH

[76] Inventor: Richard M. Hyman, 18 Glendale Ct., Iowa City, Iowa 52240

[21] Appl. No.: 482,065

[22] Filed: Apr. 5, 1983

[51] Int. Cl.[4] ..... A45D 24/16

[52] U.S. Cl. ..... 132/120; 132/85

[58] Field of Search ..... 132/85, 120

[56] References Cited

U.S. PATENT DOCUMENTS

| | | | |
|---|---|---|---|
| 2,482,928 | 9/1949 | Neff et al. | 132/85 |
| 4,161,050 | 7/1979 | Sasaki | 132/85 |
| 4,475,563 | 10/1984 | Martin | 132/85 |

FOREIGN PATENT DOCUMENTS

| | | | |
|---|---|---|---|
| 2119243 | 11/1983 | United Kingdom | 132/11 R |

*Primary Examiner*—Gregory E. McNeill

*Attorney, Agent, or Firm*—Vorys, Sater, Seymour & Pease

[57] ABSTRACT

An improved hairbrush suitable for use both in general brushing and in conjunction with an air dryer for blow drying and styling hair includes a rigid body having an elongated handle and an elongated brush block or base. The brush block has back and face portions and a body of bristles are mounted on and project from the face. The brush block has a pair of integrally formed air baffles extending one along each side edge portion thereof and projecting in outwardly diverging relation from the face of the block and in outwardly spaced relation to the brush bristles, with the brush block and baffles cooperating to form a concavity or channel for trapping and redirecting a stream of air directed into the hair from one side of the brush by a conventional blow dryer. The outwardly projecting wing-like baffles may also be employed as an aid in molding and shaping the coiffure.

12 Claims, 5 Drawing Figures

AIR BAFFLED HAIRBRUSH

BACKGROUND OF THE INVENTION

This invention relates to hair brushes and more particularly to an improved hair brush for use both in general brushing and with blow styling dryers for drying and styling the hair.

DESCRIPTION OF THE PRIOR ART

Hairbrushes of the type employed in styling hair normally include a rigid body having a generally elongated brush block or base and a handle portion projecting from one end of the brush block. Bristles arranged either individually or in tufts project from a face surface of the brush block, which surface may either be generally flat or curved.

Blow dry brushes are also known in which the brush block is formed as an open lattice-type structure with the bristles arranged on spaced bars. Such blow dry brushes frequently are substantially arcuate in cross section, with the bristles and supporting bars being spaced apart a distance to permit air from a conventional blower type air dryer to pass through the bristles and brush block. One known prior art hairbrush is specially designed for use with a blow styling dryer as shown in U.S. Pat. No. 4,076,032 includes a body portion having a coaxial handle and cylindrical brush block. An axial bore extends through the cylindrical brush block, and arcuate slots formed in the surface communicate with the bore so that air can pass through the arcuate slots and into the central bore then longitudinally of the brush block to be discharged from an opening in the free end.

The bristles used on blow dry brushes are normally relatively widely spaced and in use are employed to lift the hair to permit more rapid drying. The open structure of the brush block and of the body of bristle permits a substantial portion of the drying air to pass directly through the brush, however, so that the most efficient use of the blow dryer is not realized. Accordingly, it is the primary object of the present invention to provide an improved hairstyling and drying brush.

Another object of the invention is to provide such a brush which enables more efficient utilization of drying air and consequently more rapid drying of the hair.

Another object of the invention is to provide such a hairbrush which is very sturdy, rugged and durable, and which is easy and relatively inexpensive to manufacture.

Another object is to provide such an improved hairbrush which is useful as a styling brush as well as a blow dry brush, and which facilitates drying and styling of the hair.

In the attainment of the foregoing and other objects and advantages, an important feature of the invention resides in providing a styling brush including a rigid body having an elongated brush block portion with an elongated handle portion preferably projecting from one end of the brush block. The brush block has a back, a face, and side edges, with bristles mounted in and projecting outwardly from the face. A pair of thin, flange-like air vanes or baffles are formed at the junction of the face and side edges of the brush block and project outwardly and forwardly, i.e., in a diverging relation relative to one another and in outwardly spaced relation to the bristles. The baffles cooperate with the block face to define a concavity or trough substantially along the length of the brush block with the brush bristles being mounted in and projecting outwardly from the trough between the baffles. The baffles are dimensioned and shaped to trap a stream of air directed at one side of the brush from a styling blow dryer and to redirect the air through the hair and along the length of the brush block to provide maximum contact of the air with the hair being brushed. In preventing the air from quickly escaping through the brush block, as in the case of conventional blow dry brushes, and by redirecting it toward the hair, the present invention maximizes contact of the air with the hair and produces a more rapid drying without excessive heat. The outer surfaces of the baffles are preferably constructed so as to blend smoothly with the brush block. The configuration of the brush is such that it may be used in the conventional manner for general brushing, as a styling brush, or as a blow dry brush.

BRIEF DESCRIPTION OF THE DRAWINGS

The foregoing and other objects and advantages of the invention will be apparent from the detailed description contained hereinbelow, taken in conjunction with the drawings, in which.

DESCRIPTION OF THE PREFERRED EMBODIMENT

Figure 4:
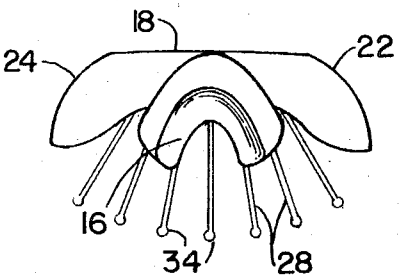
FIG. 4 is an elevation view of the other end of the brush.

Referring now to the drawings in detail an improved blow dry and styling brush embodying the present invention is designated generally by the reference numeral 10 and includes a rigid body 12 preferably integrally molded from a single mass of synthetic resin material and having an elongated brush block portion 14 and a handle portion 16. The handle 16 may be of any desired configuration, but preferably is of noncircular cross section as best seen in FIG. 4 and is contoured to be easily grasped and manipulated by one hand in the conventional manner.

Figure 1:
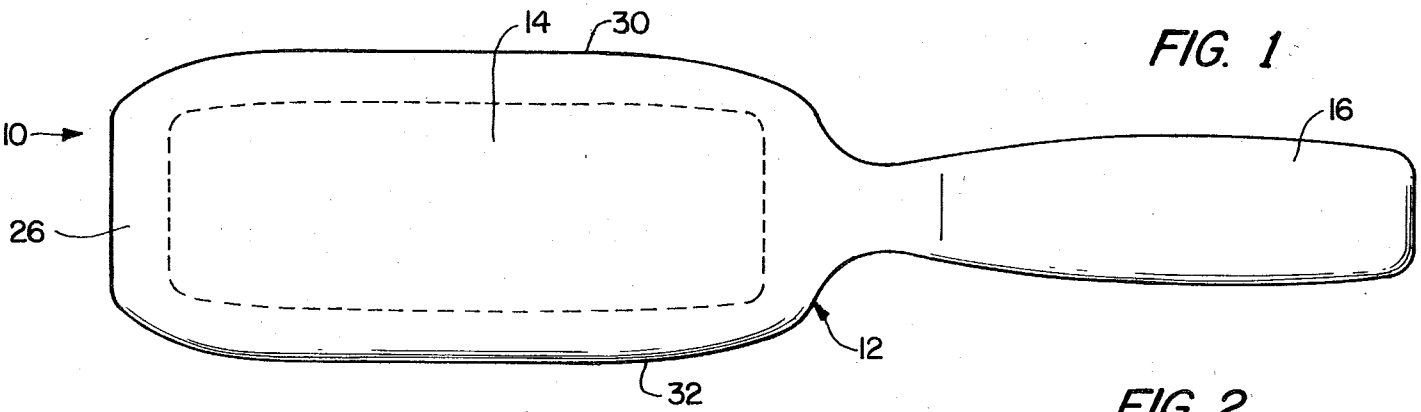
FIG. 1 is a plan view of an improved brush embodying the invention.

The brush block portion 14 of body 12 is preferably oblong or generally rectangular in configuration when viewed from the back, or in plan view as shown in FIG. 1 In the embodiment illustrated, the brush block portion 14 has a substantially planar back surface 18, a slightly convex face surface 20, curved side edge surfaces 22 and 24 and an end edge surface 26. A plurality of brush bristles 28 are fixed in and project forward, or outwardly from the face surface 20. Bristles 28 may be secured to block 14 individually or in tufts arranged in rows or other desired pattern for use in styling or as an air brush for drying.

Figure 2:
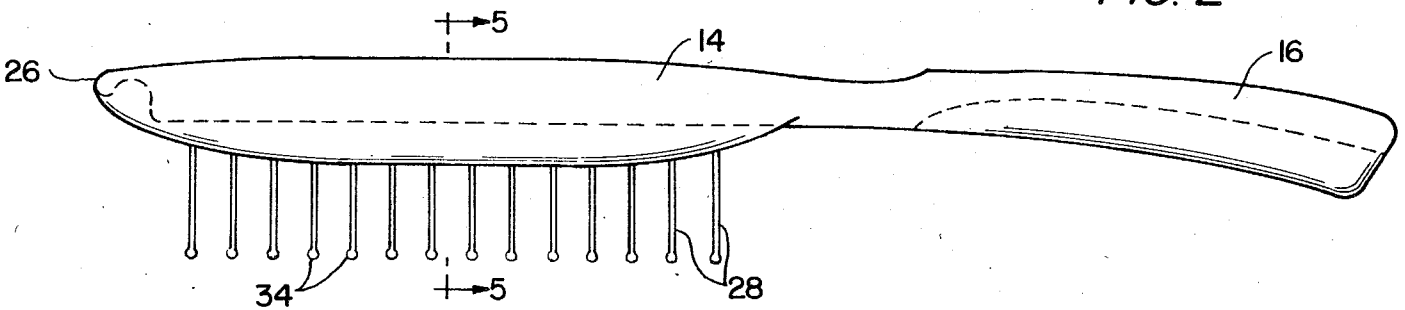
FIG. 2 is a side elevation view of the brush shown in FIG. 1.
Figure 5:
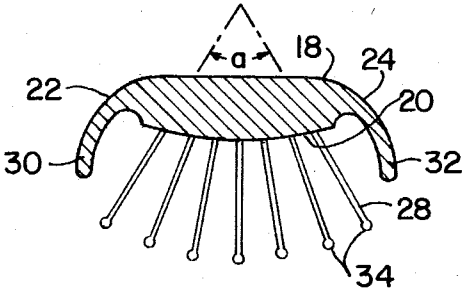
FIG. 5 is a sectional view taken on line 5—5 of FIG. 2.

As most clearly seen in FIGS. 2, and 5, a pair of vane-like baffle members 30, 32 are integrally formed along the edges of the brush block at the intersection of the face surface 20 and the side edge surfaces 22, 24, respectively, with the baffle members 30, 32 extending forwardly and in outwardly diverging relation along the length of the brush block in spaced relation to the body of brush bristles 28.

Baffle members 30, 32 are relatively thin and may extend around and be joined at the end surface 26. The baffles cooperate with the face surface 20 to define an elongated concavity or air trough with face surface 20 forming the bottom of the trough and the bristles projecting outwardly from the trough between the baffles. At the other end of the brush block portion, the baffle members 30, 32 preferably merge smoothly into the handle 16 at the juncture of the handle and brush block.

It should be apparent that the improved brush can be utilized for styling or general purpose brushing in the conventional manner. When used as a styling brush, the contoured, outwardly projecting vane-like baffle members 30, 32 can be conveniently used to shape and mold the coiffure. When used as a blow dry brush, the bristles 28 may be used to lift and brush the hair in the conventional manner as the brush is manipulated with one hand while a separate blow dryer held in the other hand directs a stream of air onto the hair from one side of the brush. When used in this manner, the brush is normally tilted to lift the hair so that the baffle member 30, 32 closest to the blow dryer will be lifted while the other air baffle will be closer to or pressed against the hair. This arrangement provides an air trap causing the air from the blower to be directed and redirected through the hair to provide maximum contact of the air with the hair. Thus, rather than permitting or actually facilitating the escape of air through the body of the brush block as in the known prior art blow dry brushes, the brush according to the present invention effectively traps the air and redirects it along the length of the brush block to achieve more rapid drying.

Figure 3:
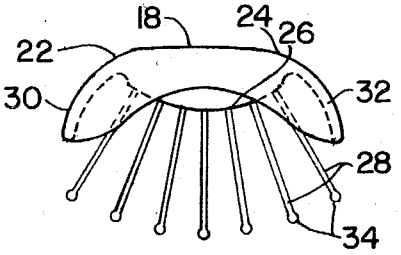
FIG. 3 is an end elevation view of the brush shown in FIGS. 1 and 2.

When the brush is to be used as a blow dry brush, the bristles are preferably arranged in longitudinally extending rows with the bristles in adjacent rows diverging slightly to provide a generally fan-shaped pattern in cross section as shown in FIGS. 3–5. The maximum included angle "a" of the fan-shaped pattern is preferably about 120° with the bristles in the outermost rows being spaced at least slightly from the outer or free edges of flanges 30, 32. In this configuration, surface 20 is preferably substantially arcuate in transverse cross section with bristles 28 projecting substantially radially from the surface.

Bristles 28 may be substantially uniform cross section throughout their length, but when the brush is intended for use as a blow dry brush, the ends of the bristles preferably have slightly enlarged ball shaped ends as illustrated, somewhat exaggerated, at 34. The use of ball shaped ends on brush bristles is known in the art and as such forms no part of the present invention. In an alternate embodiment single strand bristles such as depicted at 38 may be replaced with conventional bristling, i.e., a series of tufts each of which comprises a multiplicity of filament strands.

When the brush of the present invention is intended for use both as a blow dry brush and as a styling or general use brush, it may be desired to employ an increased bristle density and/or a less fan-shaped or more nearly trapezoidal cross sectional pattern of the bristle body. Also, the surface 20 may have less curvature or even be substantially planar. Thus, while a preferred embodiment of the invention has been disclosed and described, it should be apparent that the invention is not so limited but rather that it is intended to include all embodiments which would be apparent to one skilled in the art and which come within the spirit and scope of the invention.

What is claimed is:

1. A hairbrush comprising an elongated rigid brush block having a face surface, a plurality of bristles mounted on said brush block and projecting outwardly from said face surface, a pair of elongated air baffles formed on and extending longitudinally of said brush block, said air baffles being located on adjacent block side edge portion of said face surface in outwardly spaced relation to said bristles and extending from said face surface in outwardly diverging relation to one another and cooperating with said face surface to form a trough extending longitudinally of said brush block for confining and redirecting the flow of air from a separate blow dryer.

2. The hairbrush as defined in claim 1 wherein said air baffles each comprise a vane-line projection integrally formed on said brush block and extending at least substantially the full length thereof.

3. The hairbrush as defined in claim 1 further comprising an elongated handle rigid with and projecting from one end of said brush block.

4. The hairbrush as defined in claim 3 wherein said air baffles each comprise a vane-like projection integrally formed on said brush block and extending at least substantially the full length thereof so as to frame the bristle elements.

5. The hairbrush as defined in claim 4 wherein said pair of air baffles extend around and are joined at the end of the brush block opposite said handle.

6. The hairbrush as defined in claim 5 wherein said brush block, said handle, and said pair of air baffles are integrally molded from a single mass of synthetic resin material.

7. The hairbrush as defined in claim 5 wherein said face surface is substantially flat.

8. The hairbrush as defined in claim 5 wherein said face surface is outwardly convex in transverse cross section and wherein said bristles are arranged in a substantially fan-shaped pattern in end elevation view.

9. The hairbrush as defined in claim 8 wherein the maximum included angle of said fan-shaped pattern is about 120°.

10. A hairbrush comprising a rigid body including having an elongated brush block portion and an elongated handle rigid with and joined to one end of the brush block for manipulation thereof, said brush block having a back surface, a face surface, and a side edge surface extending between said back and face surfaces, a plurality of brush bristles having their inner ends secured to said brush block portion and projecting outwardly from said face surface, and air baffle means on said brush block portion, said air baffle means extending from said brush block around at least a major portion of said face surface in outwardly diverging relation and in the general direction of and in outwardly spaced relation to said bristles, said baffle means and said face surface cooperating to define a concavity into which the inner end portion of the brush bristles project, said concavity being adapted to trap and redirect air from a separate blow dryer to facilitate drying of hair.

11. The hairbrush as defined in claim 10 wherein said air bristles means comprises a vane-like projection having an outer surface forming a continuation of said side edge surface.

12. The hairbrush defined in claim 11 wherein said rigid body and said air baffle means are integrally molded from a single mass of material.

* * * * *